US005253906A

United States Patent [19]

Rogers, Jr. et al.

[11] Patent Number: 5,253,906

[45] Date of Patent: Oct. 19, 1993

[54] LINKAGE FOR VEHICLE DOOR LATCH

[75] Inventors: Lloyd W. Rogers, Jr., Shelby Township, Macomb County; John I. Moceanu, Sterling Heights, both of Mich.

[73] Assignee: General Motors Corporation, Detroit, Mich.

[21] Appl. No.: 878,064

[22] Filed: May 4, 1992

[51] Int. Cl.[5] ..... E05C 3/26

[52] U.S. Cl. ..... 292/216; 292/336.3; 292/DIG. 22

[58] Field of Search ..... 292/216, 280, 336.3, 292/DIG. 22, DIG. 23, DIG. 26, DIG. 27

[56] References Cited

U.S. PATENT DOCUMENTS

| | | | |
|---|---|---|---|
| 3,695,663 | 10/1972 | Cockburn | 292/216 |
| 3,799,596 | 3/1974 | Nozomu et al. | 292/DIG. 22 X |
| 3,990,531 | 11/1976 | Register | 292/DIG. 22 X |
| 4,277,037 | 7/1981 | Loose et al. | 242/216 |
| 4,756,563 | 7/1988 | Garwood et al. | 292/216 |

*Primary Examiner*—Richard E. Moore
*Attorney, Agent, or Firm*—Charles E. Leahy

[57] ABSTRACT

This vehicle door latch assembly incorporates a blocker bar which has a follower operatively mounted within a conical recess of an upstanding block so that when subjected to an unbalancing force of predetermined magnitude, the block will be tilted and the bar moved to a block position in which a transfer lever of the latch assembly is inhibited from turning. An associated intermittent lever is resultantly immobilized so that a connected detent lever cannot be moved from a holding position with respect to a spring biased locking bolt. With the locking bolt so held, it cannot be moved from a latching position with respect to a striker to thereby prevent door opening. When door opening is subsequently desired, an unblocking lever system can be actuated to cam the blocker bar to a release position allowing the transfer lever to be turned by a pull handle and a connected release rod to effect the spring biased movement of the locking bolt to an unlatching position with respect to the striker. A dual lever holding system on the release lever rod and on lock control rod is operable to hold the lock control rod in an unblocking position until the pull handle is released from a door opening position so that the lock control rod is returned to its unlocked position.

11 Claims, 5 Drawing Sheets

LINKAGE FOR VEHICLE DOOR LATCH

TECHNICAL FIELD

This invention relates to vehicle door latches for releasably securing a hinged door in the door frame provided in the vehicle body work, and more particularly, to a new door latch.

BACKGROUND OF THE INVENTION

Prior to the present invention, various door latches have been devised for selective securement of a hinged vehicle door in the frame therefor as provided by the body work of the vehicle. Examples of such latches can be found in U.S. Pat. No. 3,695,663, issued Oct. 3, 1973, to Stanley Cockburn for "CLOSURE LATCH", and in U.S. Pat. No. 4,756,563, issued Jul. 12, 1988, to Stephen Garwood et al for "VEHICLE DOOR LATCH" both assigned to the assignee of this invention and hereby incorporated by reference.

These latches and other latches commonly used in motor vehicles are known to effectively latch the door and comply with all applicable governmental regulations.

The present invention is of the general category of the above referenced door latches which securely holds the door in latched and locked positions and allows convenient entrance and egress as desired by vehicle passengers.

The present invention provides a new blockout that may be engineered into a wide range of door latching systems. Furthermore, this invention incorporates construction to effectively return the mechanism to an unblocking position by the normal unlocking motion of a locking-unlocking mechanism incorporated within the door to an unblocking third position allowing convenient and easy egress when desired. In this invention, the locking lever of the door latch is selectively movable by a garnish button or manual or powered slide bar to a first or locked position in which the striker is entrapped by the locking bolt so that the locking lever cannot turn the lock bolt to the unlatched position until the door locking-unlocking lever system has been moved by the slide bar from the locked position to a second or unlocked position.

Importantly in this invention, the locking lever can be readily moved to a third position by the slide bar in which a block activated blocker bar is moved to an unblocked position. The third position is obtained by the moving of the locking-unlocking lever system in the conventional unlocking direction to the unblocked position so that the door can be opened for passenger egress. The block will blockout unlatching of the door in both lock and unlock positions by resulting tilting of a blocker bar moving the locking lever to a third position in direction of unlocking will remove the blocking by the blocker bar.

Furthermore in this invention, a pair of lever mechanisms interface (1) the inside door unlatching handle linkage, and (2) the locking lever system that may be actuated by the interior manual or powered slide bar, or garnish button to move the locking lever in the locked or unlocked position. These lever mechanisms cooperate to retain the locking lever in an unblocked position and to subsequently remove this retention on the return of the inside handle to its normal stowed position.

The present invention is designed to be housed within the existing structure of the door and automatically locks the door latch independently of the locking lever and incorporates an unblocking system that can be readily operated with one hand using normal unlocking force. The system is self restoring with each activation of the inside handle and is a straight forward system that can be economically produced.

These and other features, objects and advantages of this invention will become more apparent from the following detailed description and drawing in which:

DETAILED DESCRIPTION OF THE DRAWINGS

Figure 1:
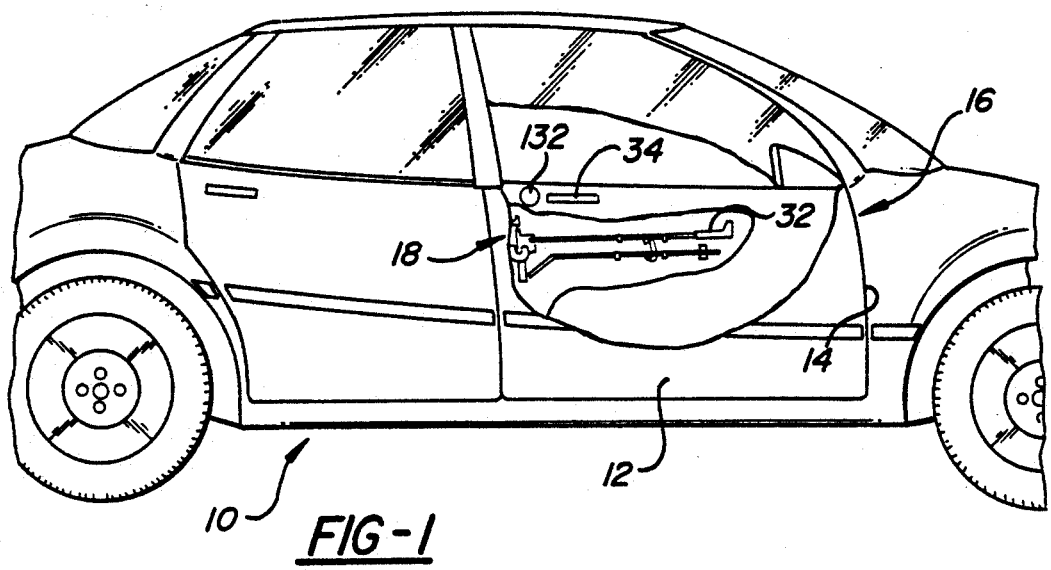
FIG. 1 is a side elevational view of a portion of a vehicle with door paneling structure partly removed showing one location of the door latch assembly and associated control linkage illustrative of this invention.
Figure 5:
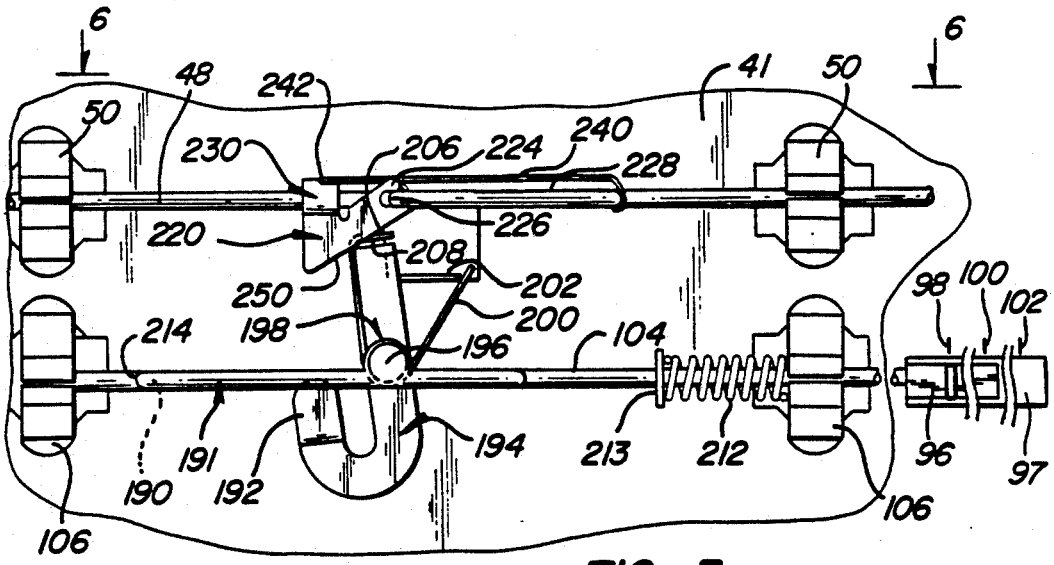
FIG. 5 is a view of a portion of FIG. 2 showing the control linkage thereof in a moved position.
Figure 6:
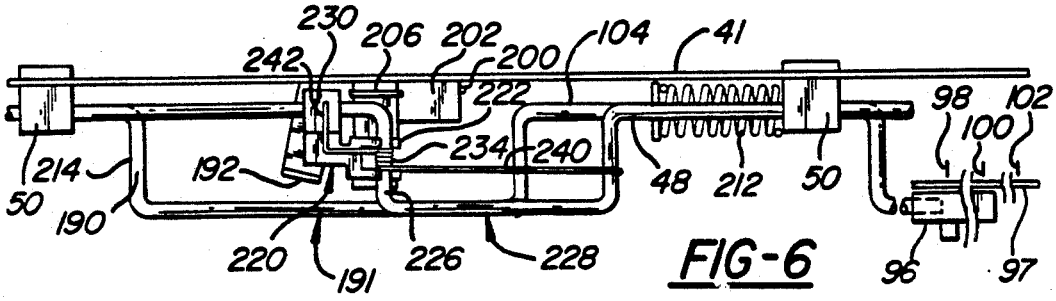
FIG. 6 is a top view of the control linkage of FIG. 5 taken generally along sight lines 6—6 of FIG. 5.

Turning now in greater detail to the drawings, a motor vehicle designated generally at 10 includes a front door 12 conventionally hinged at its forward side 14 to the front pillar of the door opening in the body 16 of the vehicle for swinging movement between open and closed positions to allow passenger entrance and egress. A door latch assembly 18 including a thick plastic main body 20, having an outboard side a metal plate 21, is secured to rearward supporting structure 22 of the vehicle door. A locking bolt 24 is pivotally mounted within the main body 20 for selective retentive engagement with a conventional striker pin 26 operatively secured to the rearward pillar of the door opening to selectively retain the door in a closed position.

Figure 2:
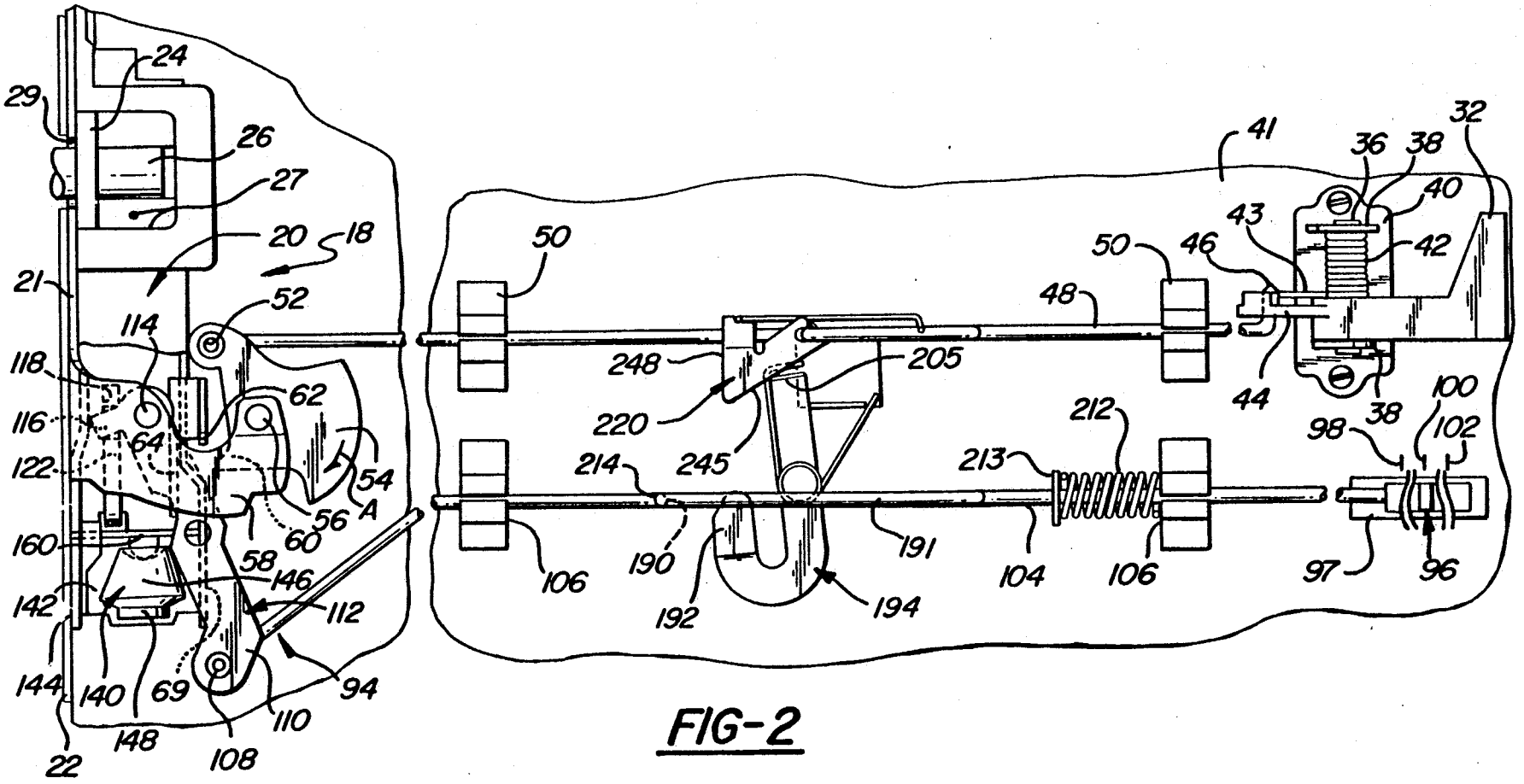
FIG. 2 is an enlarged side elevational view of the door latch assembly and control linkage of FIG. 1 with some parts removed and with parts broken away.
Figure 3:
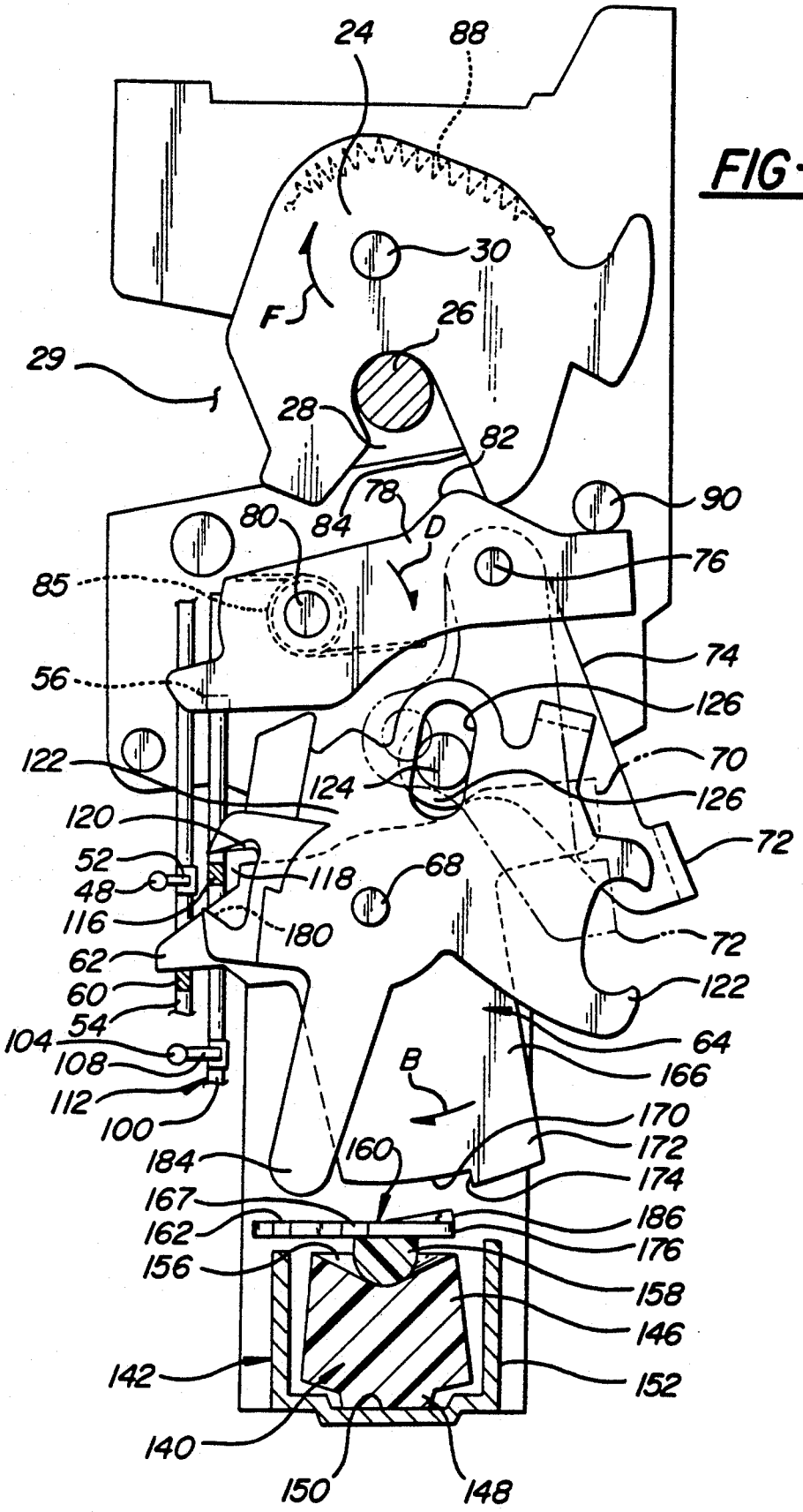
FIG. 3 is a diagrammatic view of the vehicle door latch assembly of FIG. 2 to illustrate one preferred embodiment of this invention.
Figure 4:
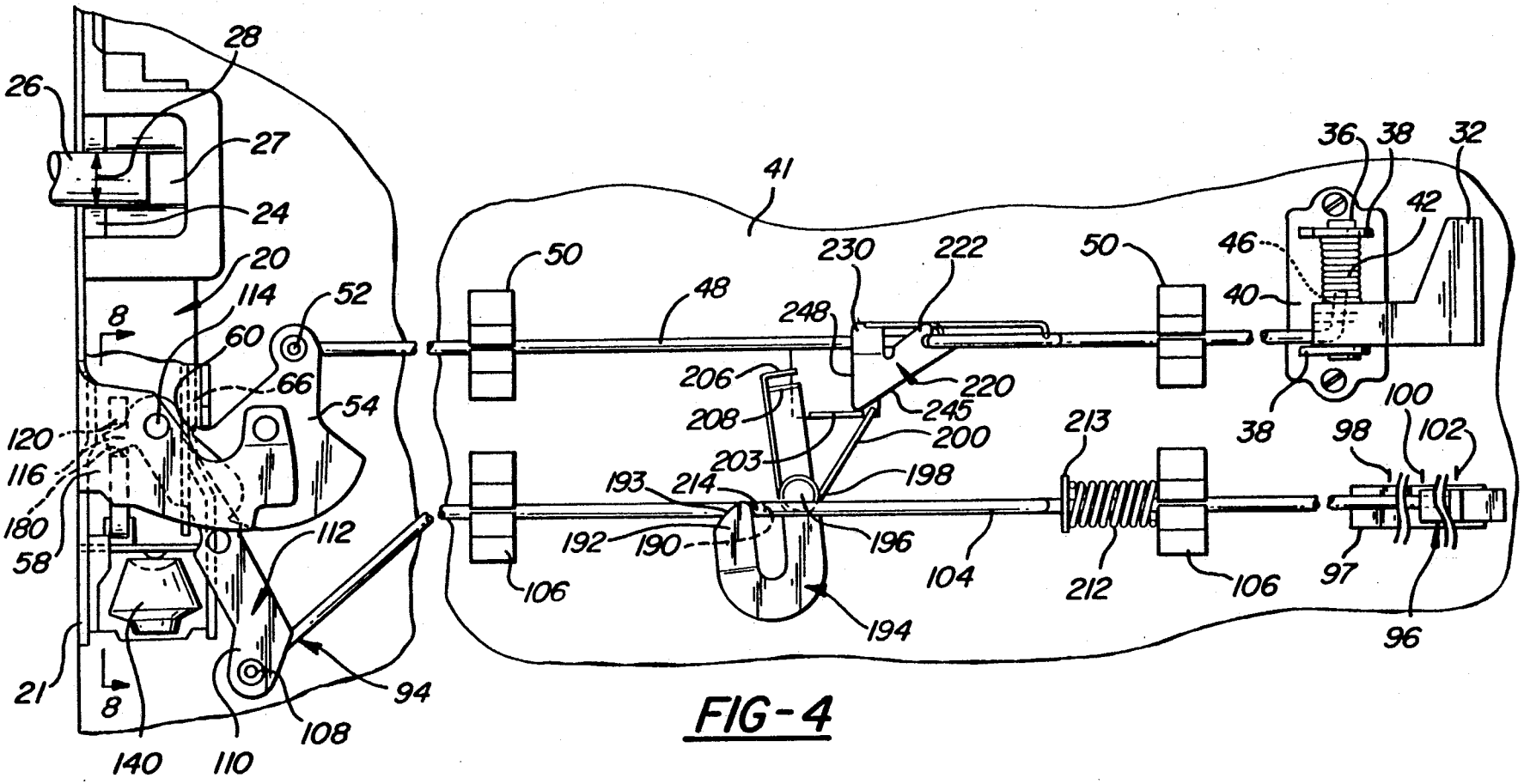
FIG. 4 is a side elevational view similar to that of FIG. 2 illustrating the latch assembly and control linkage in a moved position.

As shown in FIG. 3, the locking bolt 24 is a flat, generally circular member which is bifurcated to have a fork or throat 28 for receiving the striker pin 26, which enters therein through an enlarged mouth 27 in the main body and a laterally extending slot 29 in the plate 21. The locking bolt 24 is mounted by pivot 30 to the main body of the latch assembly for turning movement between latched and unlatched positions in which the fork of the bolt is closed around the striker pin 26 (FIGS. 2 and 3) and an open position in which the fork or throat of the bolt is aligned with the mouth 27 of the main body to receive or release the striker pin (FIG. 4). The locking bolt 24 can be selectively turned to the unlatched position by interior and exterior pull handles 32 and 34 that are operatively connected to the bolt 24 by a system of interacting levers diagrammatically illustrated in FIG. 3, and generally similar to the lever system disclosed in the above referenced U.S. Pat. No. 4,756,563 to Garwood et al.

FIGS. 2 and 4 best illustrate the inside pull handle 32 mounted on a pivot shaft 36 secured to vertically spaced and projecting ears 38 of a bracket 40 mounted by threaded fasteners to an inner panel 41 of the door. A torsion spring 42 extending around the shaft 36 and has one end grounded to the bracket 40 and the other end 43 connected to an offset lever portion 44 of the handle 32 to exert a spring force thereon to bias the handle to a closed position after its manual release.

The offset lever portion 44 of the handle is pivotally connected to the upstanding end 46 of an elongated inside release handle rod 48 that extends longitudinally within the door and is slidably mounted therein through guides 50 secured to the door panel 41. As shown, the release rod 48 terminates in a pivot connection 52 to an extending arm of a flat inside operating or remote lever 54 that is mounted for limited pivotal motion by pivot 56 supported by a bent-over flange 58 of the metal side plate 21.

By pulling the handle 32 outwardly so that it turns on its pivot shaft 36 against the force of spring 42, the rod 48 will be pulled toward the handle 32 causing remote lever 54 to be turned clockwise from the FIG. 2 to the FIG. 4 position. This action results in the engagement of projecting actuator finger 60 of remote lever 54 with an extending contact arm 62 of a transfer lever 64, best shown in FIG. 3, to urge lever 64 to turn clockwise, arrow B, on pivot 68 mounted to a metal side plate 69 secured to the other side of main body 20. The main body 20 of the latch assembly is sandwiched between the side plates 21 and 69.

As shown best in FIG. 3, the transfer lever 64 has an extending upper actuator arm 70 that when turned in the clockwise direction engages an extending tab 72 of an intermittent lever 74 when the lever is in the phantom line position. As the transfer lever 64 continues its clockwise turning movement, the intermittent lever 74 will be pulled downwardly by the actuator arm. The intermittent lever 74 is attached by a pivot pin 76 to a detent lever 78 which is pivoted in the main body 20 by pivot 80.

On the downward movement of the intermittent lever, the detent lever 78 resultantly turns in a clockwise direction, arrow D, and the detent lever blocking shoulder 82 will move from contact with the stop surface 84 on the inboard leg of the lock bolt throat 28 which receives the striker pin 26. When this happens, a helical tension spring 88 which has been stretched on the closure of the door 12, contracts to turn the lock bolt 24 clockwise, arrow F, so that the throat 28 is turned to an opened position shown in FIG. 4 to allow the door to be swung outwardly for passenger egress or for passenger entrance.

On return of the door to the closed position, the striker pin 26 will engage the inboard surface of the leg of the throat 28 of the locking bolt to rotate the locking bolt counterclockwise back to the FIG. 3 position and again stretch spring 88. Torsion spring 85 biases the detent lever to the latching position against stop 90, as shown in FIG. 3. Other springs of this lever system, are not shown to simplify the drawing but their constructions and operations are substantially the same as disclosed in U.S. Pat. No. 4,756,563 to Garwood et al.

In addition to the latching and unlatching provided by this invention, there is further incorporated a locking linkage 94 that can be employed to secure the door 12 in a latched and locked condition, a latched and unlocked condition and in an unblocked position. To this end, there is an interior manual or powered slide bar 96 mounted in a recessed support bracket 97 and movable between (1) a locking position 98 in which the locking bolt throat is held in the latched and locked position and cannot be turned by the pull handles, and (2) an unlocked position 100 in which the throat of the locking bolt can be, or is, turned to the opened position by operation of the interior or exterior pull handles and their associated linkages, and (3) to an unblocked position 102 which will be described below.

As best shown in FIGS. 2 and 4, the interior slide bar 96 is fixed at its inner end to the end of an elongated lock control rod 104 that is slidably mounted relative to the interior panel 41 by retainers and guides 106. The rod 104 terminates in a pivot connection 108 with an elongated arm 110 of an inside lock control lever 112 that is pivoted by pivot 114 to the flange 58 of the door latch assembly. When the slide bar is linearly moved from the unlocked position 100 to the locked position 98, the lock control lever 112 will be turned on pivot 114 in a clockwise direction with particular reference to FIG. 2. On this turning movement, a finger 116 of the lock control lever 112 engaged in a recess 118 in a locking lever 122 engages an upper contact surface 120 thereof to turn the locking lever 122 in a clockwise direction on pivot 68.

A follower pin 124 projecting from the intermittent lever 74 that fits within a camming slot 126 formed in the locking lever 122, follows the movement of the camming slot to turn the intermittent lever 74 to the full line position of FIG. 3, in which the contact tab 72 is correspondingly moved to an out-of-way or lock position with respect to the actuator arm 70 of the transfer lever 64. In this "lock" position, the actuator arm 70 "free wheels" past the tab 72 of the transfer lever so that the detent lever and the locking bolt remain in the locked position. Accordingly, with the slide 96 in the locked position, the inside or outside handle cannot be pulled to open the door 12 until the locking linkage 94 is returned to the latched but unlocked position of FIGS. 2 and 3, or to the unblocked position which will be described.

Figure 9:
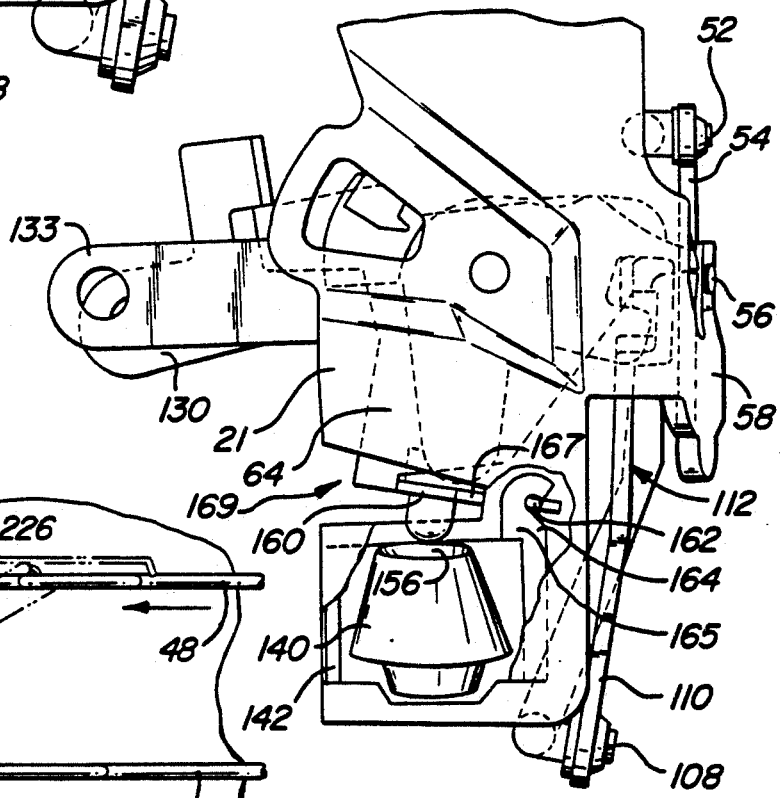
FIG. 9 is a view similar to that of FIG. 8 showing additional components of the latching system and the latching system in a locked condition.

The outside handle 34 is operatively connected to a control lever 130 shown in FIG. 9 which is connected to the transfer lever 64 of the latch assembly by a linkage system, not shown, so that when the locking linkage 94 is in a latched but unlocked condition (FIG. 2), the locking bolt 24 can be turned by the handle 34 to the opened position allowing the door to be moved from the closed position for passenger entrance. Similarly, a lever system, not shown, is connected to an outside door key cylinder 132 to the key cylinder lever 133, which is operatively connected to the locking lever 122 and to the intermittent lever 74 to move the tab 72 between the "freewheel" locking position and the latched and unlocking position, thereby allowing the lock cylinder to be turned by the key to lock and unlock the door. These linkages are described in the above referenced U.S. Pat. No. 4,756,563 to Garwood et al so that further detailed description is not necessary for these components.

In this invention, a sensing block is provided for a door latching system such as described above. In a preferred embodiment, the vehicle door latch assembly 18 is provided with inverted or standing block which will cause the unlatching capability of the latch assembly to be blocked and thereby locked even though the locking linkage 94 is in a latched but unlocked condition, FIG. 2, when the vehicle and block are subject to a predetermined stimulus.

As shown in the preferred embodiment, a standing block 140 is operatively mounted in a cage 142 which is secured between the laterally spaced side plates 21 and 69 at the lower end of the door latch assembly 18. The standing block 140 has its mass centered at 146 and the enlarged conical head portion extends upward from a cylindrical support pedestal or foot 148 that is supported on the inner surface 150 of the cage 142.

The cage 142 has a cylindrical wall 152, which is suitably spaced from the head of the block when in upright position so that the block can tilt from a standing position to an inclined position when subjected to an unbalancing force of predetermined magnitude or greater. The block is formed with a conical camming recess 156 in the upper surface thereof which receives the partly spherical follower 158 depending from a flat rectilinear blocker bar or plate 160.

The blocker bar 160 has a pair of pivot tabs 162 extending from opposite side edges thereof that pivotally fit into retainer portions 164 of the upwardly extending and laterally spaced arms 165 of cage 142 so that the blocker bar 160 can pivot on its pivot tabs 162 from a horizontal position in which a lower and downwardly extending arm portion 166 of the transfer lever 64 can turn or free wheel past the blocking bar to an inclined or tilted position, see FIG. 9, in which the blocker bar limits the unlatching movement of the transfer lever 64 so that it cannot turn any further and the associated intermittent and detent levers are immobilized and the striker pin will remain captured by the locking bolt. The blocker bar also has another pair of tabs 167 which extend through the wedge shaped cut outs 169 in the side plates which can contact the interfacing edges thereof to limit blocker bar rotation.

Figure 8:
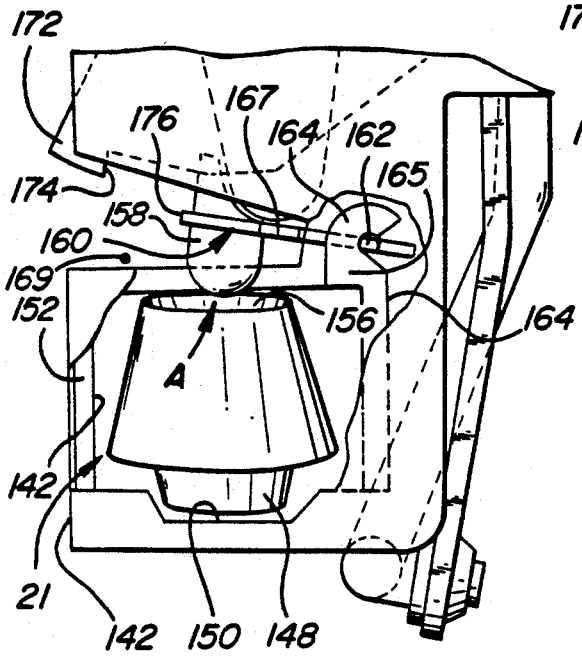
FIG. 8 is an enlarged view of a portion of the latching system of this invention.

The lower end of the transfer lever 64 is formed with an offset tooth 172 that has a radial contact surface 174 that is engagable with a forward edge 176 of the blocker bar when the blocker bar has been tilted by the movement of the block 140, as shown in FIGS. 8 and 9. Accordingly, the block tilts so that the transfer lever 64 is blocked and the door will be held in a locked condition until the block returns to an upstanding position.

In the event the block and blocker bar remain in tilted positions such as might occur if the vehicle is on a sharply inclined surface, the door 12 can be opened by the manual linear movement of the slide bar 96 to the right in a natural unlocking movement until the manual overriding and unblocking position 102 is reached, as shown in FIG. 4.

When the slide bar 96 is displaced to the unblocking position 102, the lock control rod 104 will turn the locking control lever 112 clockwise on pivot 114. This action causes the finger 116 of the lock control lever to contact surface 180 (FIG. 3) on the locking lever 122 causing it to rotate counterclockwise. The locking lever 122 has a depending arm 184 with a lower control surface that sweeps across the upper surface of the blocker bar 160 to contact the upper surface of an inclined ramp 186 which is affixed to the top of the blocker bar. As the depending arm 184 reaches the top of the inclined surface provided by the ramp 186, the blocker bar will be pivoted on its pivot tabs 162 to a flat or an unblocking position and the block forced to an upright position in its cage.

Figure 10:
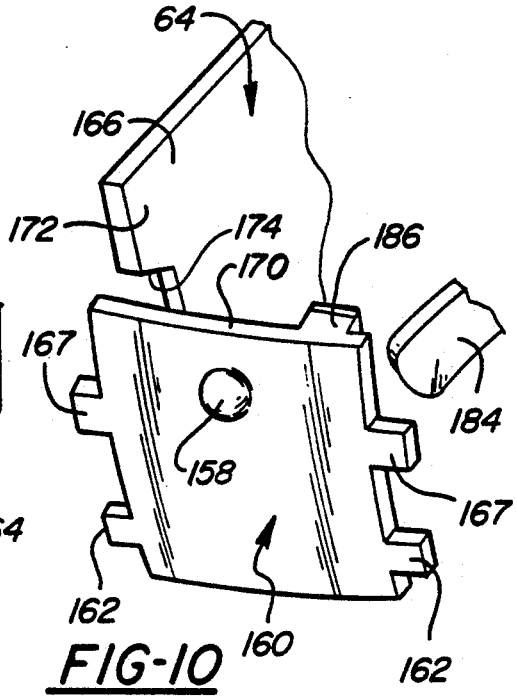
FIG. 10 is a pictorial view of the blocking bar of the locking system as viewed in the direction of sight arrow A of FIG. 8.

In this position of the blocker bar, the door handles can be pulled to their open position effecting rotation of the transfer lever 64 past the blocker bar. When this occurs, the intermittent lever will be moved to effect rotation of the detent lever and the locking bolt will be biased by its spring 88 to an unlocked position. As shown in the pictorial view, FIG. 10, the inclined ramp 186 is offset with relation to the transfer lever 64 so that there is no interference between the transfer lever and the inclined ramp.

When the slide bar 96 has been moved to the manual overriding and unblocking position 102, a control leg 190 of the generally U-shaped and laterally offset segment 191 of the rod 104 engages the inclined forward edge 193 of the offset hooked end 192 of a J-shaped holding lever 194. The movement of the rod 104 to the FIG. 4 position causes the lever 194 to turn counterclockwise on pivot 196 extending from the door panel 41 against the action of a return torsion spring 198, which is coiled about the pivot 196 and has one end 200 grounded on a fixed tab 202 extending from the support within the door, and the other end 206 hooked around an extending retainer portion 208 projecting at right angles from the top of the leg of the J-shaped holding lever 194.

When the contact leg 190 of the rod 104 engages the hooked end 192 of the holding lever 194, the holding lever is turned counterclockwise until the leg 190 passes over the hooked end of the holding lever.

Subsequently, the holding lever 194 under the action of the torsion spring 198 quickly returns the holding lever to the position shown in FIG. 4 to thereby trap the lock control rod 104 in the unblocked position in which the depending arm 184 holds the blocker bar 160 in a release position allowing the inside door handle to be pulled and the door to be opened.

Helical spring 212 coiled around rod 104 seats against the rod guide 106 and biases against a retainer 213 affixed to the rod to urge the rod 104 to the left in the Figures so that the outer surface 214 of the leg 190 contacts the inner surface of the hooked end of the holding lever. The holding lever cannot turn in the clockwise direction from the FIG. 4 position since the leg thereof contacts tab 202. Accordingly, the holding lever holds the rod in the unblocked position shown in FIG. 4. The door handle 32 can then be pulled to pull the release handle rod 48 and through the lever system described to move the locking bolt to the open position allowing the door to be opened.

After the door handle 32 is released, the door handle linkage rod has disengaging construction that will automatically effect the release of the unblocking function provided by the J-shaped holding lever 194 and its holding contact with the outer surface of leg 190 of the U-shaped offset segment 191.

Figure 7:
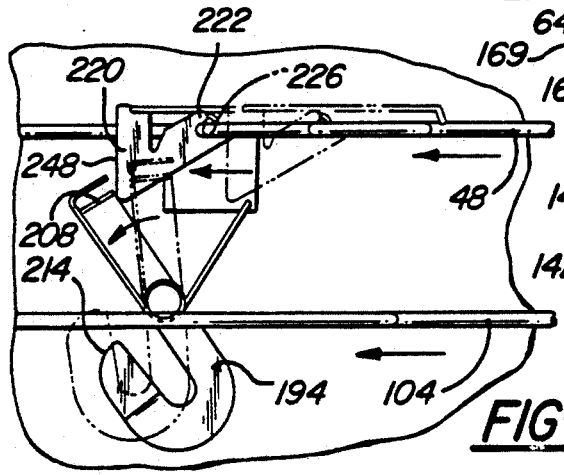
FIG. 7 is a view generally similar to that of FIG. 5 showing the linkage thereof moved to another position.

To this end, when the operator releases the inside handle 32, the torsion spring 42 will turn the handle to its closed position and the linkage rod 48 will travel toward the latch assembly which causes a disengaging lever 220 mounted on rod 48 to remove the unblocking feature, as illustrated in FIG. 7.

The disengaging lever 220, is in elevational view, a generally V-shaped element having a head portion 222 at one arm end that forms a fork 224 providing a recess which receives one leg 226 of a U-shaped offset portion 228 of the inside release handle rod. The recess of the fork provides a pivot for the disengaging lever so that it can pivot on the leg 226 of the offset of rod 48. The other end of the disengaging lever has a head portion 230 which is arched to provide a recess to fit on top of the rod 48. A torsion spring 234 has a coiled body wound on the leg 226 of the rod offset and between the arms of the fork and a first arm 240 that is bent to ground on the top of the other leg 241 of the offset portion 228. The second arm 242 of spring 234 has an end bent at right angles into a recess formed transversely in the arched head portion 230 of the disengaging lever. With this construction, the disengaging lever 220 will be spring biased in a counterclockwise direction with the arched head 230 limiting this movement.

When the handle 32 is initially pulled from the FIG. 2 to the FIG. 4 position to open the door, the edge 245 of the disengaging lever will strike the retainer portion or arm 208 of the holding lever so that the disengaging lever 220 will turn clockwise on its pivot fork against the action of helical spring 234 and move upward as the rod 48 moves from the FIG. 2 to the FIG. 4 position. In the position of FIG. 4 the disengaging lever is in a seated position and ready to effect disengagement of the holding lever.

Accordingly, when the pull handle 32 is released, it returns to the stowed position under action of the spring 42 and this action strokes the release handle rod 48 in a linear direction toward the latch assembly. The outside camming surface 248 of the disengaging lever 220 will contact the extending retainer portion 208 of the holding lever 194 causing the holding lever 194 to pivot in a counterclockwise direction. When the holding lever is pivoted to its release position of FIG. 7, the lock control rod 104 and connected components are moved by the force of compressed spring 212 to the unlocked position shown in FIG. 2.

Accordingly, the two lever mechanisms 194 and 220 interface the inside handle linkage system and the locking slide linkage system to releasably hold the locking levers in an unblocked position and to automatically remove the holding feature on the return of the inside handle to its normal spring biased stowed position, shown in FIG. 2. This construction is a reliable mechanical system which allows the single handed door release operation when locked by the block and is self restoring to a normal unlocked position with release of the inside pull handle.

While a preferred embodiment of the invention has been shown and described, other embodiments will now become apparent to those skilled in the art. Accordingly, this invention is not to be limited to that which is shown and described but by the following claims.

We claim:

1. A vehicle door latch assembly for releasably securing a door hinged for swinging movement between opened and closed positions with respect to a door opening in a vehicle body having striker means associated therewith comprising main body means adapted to be secured to the door, a locking bolt associated with said striker means and supported by said main body means and movable to a first position by the striker means when said door is moved to said closed position so that said striker means is captured by said locking bolt to retain the door in a closed position, selectively operable lever system means including a transfer lever for effecting the movement of said locking bolt from said first position in which said striker means is captured by said locking bolt to a second position in which said striker means is released from capture by said locking bolt to allow said door to be opened, a locking linkage including a locking lever associated with said lever system means and movable between an unlocking position to allow said lever system means to effect the movement of said locking bolt to said second position in which said door can be opened and a locking position in which said lever system means is unable to effect the movement of said locking bolt to said second position so that said door cannot be opened by said lever system means, displaceable block means responsive to an unbalancing force greater than a force of predetermined magnitude to move from an initial position in which said lever system can move said locking bolt to said second position so that the door can be opened to a blocking position in which said lever system means is blocked from effecting the opening of the door, and unblocking means associated with said locking linkage to move said block means from said blocking position to said initial position so that said lever system means can be actuated to effect the movement of said locking bolt back to said second position in which said striker means is released from capture by said locking bolt.

2. A door latch assembly for releasably securing a swingable door of a vehicle to a door opening in the body work of the vehicle comprising lock bolt means for selectively engaging a striker pin means affixed to the vehicle and extending into the opening and movable to a first position to capture said striker pin to releasably secure the door in a position closing said opening, first lever system means for opening said door by movement of said door lock bolt means so that said door can be opened, said first lever system means including transfer lever means, blocker plate means associated with said transfer lever means and movable between an unblocked position in which said transfer lever means can be turned to open said door and a blocked position in which said transfer lever means is blocked by said blocker plate from turning so that said door is held by, said lock bolt means in a closed position, and block means movable between a first station to a second station in response to a predetermined block load for moving said blocker plate means to said blocked position, and operator means for selectively moving said blocker plate means from said blocked position back to said unblocked position so that said door can be opened.

3. A door latch assembly for releasably securing a door of a vehicle to a door opening in the body work thereof comprising movable lock bolt means for selectively engaging and locking onto striker pin means affixed to the opening in which the door is to be releasably secured, manual handle means, lever system means to operatively connect said manual handle means to move said door lock bolt means so that said door can be opened by said manual handle means, said lever system means including transfer lever means adapted to be turned with respect to a pivot therefor, block bar means movable between a first position in which said transfer lever means can be turned by said handle means to effect the release of the striker pin means by said lock bolt means allowing the door to be opened and a second position in which said transfer lever means is inhibited from turning so that said door is held by said lock bolt means in a closed position with respect to said opening by the locking engagement with said striker pin means, and block means disposed beneath said block bar means for moving said block bar means to said second position so that said door is locked in said opening.

4. A door latch assembly for releasably attaching an occupant entrance and egress door of a vehicle to a door opening in the body work of the vehicle comprising lock bolt means for selectively engaging a striker pin means extending from body work of the vehicle into the opening, manually actuatable door opening means, lever system means to operatively connect said manually actuatable door opening means to said door lock bolt means so that said door can be opened by said manually actuatable door opening means, said lever system means including transfer lever means, pivot means pivotally supporting said transfer lever means for limited turning movement, blocker means movable between a first position in which said transfer lever means can be turned by said manually actuatable door opening means to a position in which said door can be opened and a second position in which said transfer lever means is inhibited from turning so that said door is securely held by said lock bolt means in a closed position, and block means responsive to a predetermined load for moving said blocker means to said second position, and a lock control rod associated with said lever system means to lock and unlock said door, and to move said blocker means from said second to said first position to allow the door to be opened.

5. A door latch assembly for releasably securing a hinged door to striker means associated with a door opening in the body work of the vehicle comprising movable lock bolt means for selectively engaging and locking onto said striker pin means, a manually operable handle, lever system means operatively connecting said handle to said lock bolt means so that said lock bolt means can be moved to a predetermined position so that said door can be opened, said lever system means including transfer lever means mounted for limited pivotal movement with respect to said door, lock plate means movable between a first position in which said lock transfer lever means can be turned by said manually operable handle to open said door and a second position in which said lock transfer lever means is inhibited from turning past a predetermined position so that said door is secured in a closed position by said lock bolt means, and block means operatively associated with said lock plate means and movable from a first station to other stations on application of a load on said block greater than a predetermined load for moving said lock plate means to said second position so that said door is secured by said lock bolt means, and manual means for mechanically moving said lock plate means from said second position back to said first position so that said door can be opened by said manually operable handle.

6. A door latch assembly for releasably securing a pivotally hinged door of a vehicle to a door opening in the body work of the vehicle comprising lock bolt means for selectively engaging striker pin means associated with the door opening, manual door opening means, lever system means to operatively connect said manual door opening means to said lock bolt means so that said door can be opened by said manual door opening means, said lever system means including transfer lever means, lock plate means movable between a first position in which said lock transfer lever means can be turned to open said door and a second position in which said transfer lever means is inhibited from turning so that said door is held by said lock bolt means in a closed and locked position, and block means movably mounted in said door for moving said lock plate means to said second position in response to the application of a predetermined load thereto, and locking linkage means movable to a locking position to effect the securement of said door in said opening so that said door remains secured even when said manual door opening means is actuated for opening the door and movable to an unlocking position in which said door can be opened by said manual door opening means and to an unblocking position in which said lock plate means is displaced by said linkage means from the second position to the first position of the lock plate means so that said door can be opened by said manual door opening means.

7. A door latch assembly for releasably securing an access door of a vehicle hinged to a door opening in the body work of the vehicle comprising lock bolt means for selectively engaging a striker pin means adapted to be affixed to the body work of the vehicle and extending into the opening in which the door is to be releasably secured, manual door opening means, lever system means operatively connecting said manual door opening means to said lock bolt means so that said door can be opened by said manual door opening means, said lever system means including movable transfer lever means, blocker means movable between a first position in which said lock transfer lever means can be turned to open said door and a second position in which said transfer lever means is blocked from turning past a predetermined point so that said door is held to said striker pin means by said lock bolt means in a closed position, and block means movable in response to a load greater than a predetermined load for moving said blocker means from said first position to said second position, and lever means for moving said blocker means from said second position back to said first position.

8. A door latch assembly operatively associated with a striker for releasably securing a swingable occupant access door of a vehicle to a door opening in the body work thereof comprising lock bolt means for selectively engaging the striker for holding the door in a releasable closed position, manually operable door handle means, lever system means operatively connecting said door handle means to said door lock bolt means so that said door can be manually opened by said door handle means, said lever system means including transfer lever means having locking tooth means thereon, block plate means pivotally movable between a first position in which said transfer lever means can be turned to open said door and a second position in which said locking tooth means of said transfer lever means directly engages said locking tooth means and said lever means is inhibited from turning past said block plate means so that said door is held to the striker by said lock bolt means in a closed position, and block means disposed below said block plate means for moving said block plate means to said second position in response to the application of a load greater than a predetermined load on said block means, and manual means operative to move said plate means back to said first position thereby allowing said door to be opened after being initially locked in response to movement of said block plate means said second position.

9. A door latch assembly for releasably securing a pivotally hinged door of a vehicle to a door opening in the body work of the vehicle comprising lock bolt means for selectively engaging striker pin means associated with the door opening in which the door is to be releasably secured, manual door opening means, lever system means to operatively connect said manual door opening means to said lock bolt means so that said door can be opened by operation of said lever system means, said lever system means including transfer lever means, blocker plate means movable between a first position in which said lock transfer lever means can be turned by said manual door opening means to open said door and a second position in which said transfer lever means is inhibited from turning so that said door is held by said lock bolt means in a closed and locked position, and block means movably mounted in said door for moving said blocker plate means to said second position in response to the application of a predetermined load thereto, and locking linkage means movable to a locking position to effect the securement of said door in said opening so that said door remains secured even when said manual door opening means is actuated to effect the opening of said door and movable to an unblocking position in which said door can be opened by said manual door opening means and further movable to an unblocking position in which said blocker plate means is displaced by said linkage means from the second position to the first position so that said door can be opened by said manual door opening means, said manual door opening means including a pull handle operatively mounted to said door, first actuator rod means extending within said door for operatively connecting said pull handle to said lever system means, said locking linkage including a locking lever associated with said lever system means, manual operator means operatively mounted to said door, second actuator rod means extending within said door adjacent to said first actuator rod means, a holding lever mounted to said door for releasably holding said second rod means and said locking linkage in said unblocking position, and a disengaging lever mounted on said first actuator rod means for contacting and moving the holding lever to effect the release of the second rod means from the unblocking position in response to the release of said pull handle from a door opening position.

10. A door latch assembly and manual latch controls operatively connected thereto for releasably securing an occupant access door pivoted for movement between opened and closed positions with respect to a door opening and an associated striker in the body work of the vehicle, said latch assembly adapted to be secured to said door and comprising:

displaceable lock bolt means for engaging the striker on the pivotal movement of the door to a closed position and being moved thereby into a locking position with respect to said striker, lever system means for moving said lock bolt means from said locking position with the striker, block means movable from a first location by an unbalancing force acting thereon to a blocking position that prevents said lever system means from moving said lock bolt means from said locking position with respect to said striker, said manual latch controls comprising manual door handle means adapted to be mounted on said door for movement between a stowed position and a door opening position, release rod means operatively connecting said manual handle means to said lever system means so that said manual handle means can be manually moved to effect release of said striker by said lock bolt means, manual control means adapted to be mounted on said door for movement between a locking station and an unlocking station and further to an unblocking station, a lock control rod means operatively connecting said manual control means to said lever system so that said manual control means can be manually moved to effect the locking of said door to the striker, the unlocking of said door with respect to said striker and the unblocking of said lever system by said block means to allow said door to be opened by said manual handle means, holding lever means for holding said lock control rod means in said unblocking position and disengaging lever means for effecting the release of said lock control rod means in response to the movement of said manual handle means from said door opening position to said stowed position so that said lock control rod means is returned from an unblocking position to an unlock position enabling said block means to effect the locking of said door.

11. The door latch and manual latch controls of claim 10, and further comprising pivot means for mounting said holding lever means for limited pivotal movement in a first direction from a stop position, said holding lever means having a hook portion at one end thereof, said lock control rod having an offset portion along the extent thereof adapted to contact and pivot said holding lever on said pivot in said first direction when said lock control rod is moved from said unlocked position to said unblocked position, spring means associated with said holding lever for turning said holding lever in an opposite direction and back to said stop position when said lock control rod has been moved to said unblocked position so that said hook portion can hold said lock control rod in said unblocked position, said disengaging lever means having a first end pivoted to said release rod and further having a contact surface to contact and turn said holding lever in said first direction when said manual door handle means is moved from a release position to a stowed position.

* * * * *